US005405268A

United States Patent [19]

Gazzara et al.

[11] Patent Number: 5,405,268

[45] Date of Patent: Apr. 11, 1995

[54] VERTICALLY ALIGNED ELECTRICAL CONNECTOR COMPONENTS

[75] Inventors: Paul Gazzara, Germantown; Julio Rodrigues; Richard Marowski, both of Collierville; George Wojtan, Germantown, all of Tenn.

[73] Assignee: Thomas & Betts Corporation, Memphis, Tenn.

[21] Appl. No.: 13,452

[22] Filed: Feb. 4, 1993

[51] Int. Cl.[6] ..... H01R 13/70

[52] U.S. Cl. ..... 439/188; 200/51.1; 439/417

[58] Field of Search ..... 439/188, 676, 417; 200/51.05, 51.09, 51.1

[56] References Cited

U.S. PATENT DOCUMENTS

| | | | |
|---|---|---|---|
| Re. 32,760 | 10/1988 | Chandler et al. | 439/188 |
| 3,654,592 | 4/1972 | Primorac | 439/637 |
| 4,106,841 | 8/1978 | Vladic | 439/637 |
| 4,449,778 | 5/1984 | Lane | 339/143 |
| 4,501,459 | 2/1985 | Chandler et al. | 339/48 |
| 4,508,415 | 4/1985 | Bunnell | 339/143 |
| 4,582,376 | 4/1986 | Olsson | 339/19 |
| 4,602,833 | 7/1986 | Grabbe et al. | 339/19 |
| 4,619,494 | 10/1986 | Noorily et al. | 339/103 |
| 4,641,906 | 2/1987 | Olsson | 339/143 |
| 4,653,825 | 3/1987 | Olsson | 339/48 |
| 4,671,599 | 6/1987 | Olsson | 439/188 |
| 4,682,836 | 7/1987 | Noorily et al. | 439/426 |
| 4,685,887 | 8/1987 | Hanning | 439/188 |
| 4,711,507 | 12/1987 | Noorily et al. | 439/292 |
| 4,711,511 | 12/1987 | Noorily et al. | 439/347 |
| 4,731,032 | 3/1988 | Noorily et al. | 439/136 |
| 4,744,769 | 5/1988 | Grabbe et al. | 439/284 |
| 4,786,258 | 11/1988 | Shaffer et al. | 439/188 |
| 4,859,201 | 8/1989 | Marsh | 439/290 |
| 4,863,393 | 9/1989 | Ward et al. | 439/507 |
| 4,883,433 | 11/1989 | Lane | 439/607 |
| 4,884,981 | 12/1989 | Chandler et al. | 439/610 |
| 4,891,022 | 1/1990 | Chandler et al. | 439/610 |
| 5,030,114 | 7/1991 | Carey et al. | 439/92 |
| 5,030,121 | 7/1991 | Noorily | 439/188 |
| 5,035,647 | 7/1991 | Schafer | 439/557 |
| 5,052,940 | 10/1991 | Bengal | 439/188 |
| 5,071,362 | 12/1991 | Martens et al. | 439/188 |
| 5,074,803 | 12/1991 | Chandler et al. | 439/347 |
| 5,088,934 | 2/1992 | Chow et al. | 439/395 |
| 5,104,337 | 4/1992 | Chow et al. | 439/470 |
| 5,112,243 | 5/1992 | Chow et al. | 439/352 |
| 5,122,076 | 6/1992 | Pitts | 439/352 |
| 5,169,346 | 12/1992 | Johnston | 439/676 |
| 5,178,554 | 1/1993 | Siemon et al. | 439/188 |
| 5,190,480 | 3/1993 | Chau et al. | 439/637 |
| 5,263,872 | 11/1993 | Marpoe, Jr. et al. | 439/188 |

*Primary Examiner*—Neil Abrams
*Attorney, Agent, or Firm*—Robert M. Rodrick

[57] ABSTRACT

An electrical connector component assembly terminates discrete conductors of a multiconductor data cable. The component assembly includes an insulative component housing having a mating end for engagement with a mating electrical connection device and a cable receiving end for terminating the multiconductor cable. A plurality of electrical contacts are supported by the component housing. Each of the contacts has a conductor terminating end and a mating connection end. The contacts are supported in the component housing in a pair of horizontally extending, vertically spaced rows with each contact of one row being aligned with a respective contact of the other row. The contacts of one row are directly electrically shunted to the aligned contacts of the other row.

19 Claims, 3 Drawing Sheets

VERTICALLY ALIGNED ELECTRICAL CONNECTOR COMPONENTS

FIELD OF INVENTION

The present invention relates to an improvement in electrical connector components. More particularly, the present invention relates to an electrical connector for terminating a multiconductor cable having vertically aligned connector components.

BACKGROUND OF THE INVENTION

In transmitting data signals, electrical connectors are commonly used to terminate signal carrying multiconductor electrical cables which interconnect the various components of the data system. Many data systems require the components to be supported in an electrically closed loop. A closed-loop system provides for continuity of signal in a multicomponent system when certain of the components are not interconnected.

In order to achieve such a closed loop when the components are frequently connected and disconnected, the connectors connecting such components use automatic shunting mechanisms so that a closed-loop connection is maintained even when the connector is in a non-connected condition. The use of such shunting connectors in a closed-loop data system is shown in numerous patents including: U.S. Pat. Nos. Re. 32,760, 4,449,778, 4,501,459, 4,508,415, 4,582,376, 4,602,833, 4,619,494, 4,641,906, 4,653,825, 4,671,599, 4,682,836, 4,711,507, 4,711,511, 4,731,032, 4,744,769, 4,859,201, 4,883,433, 4,884,981, 4,891,022, 5,030,114, 5,030,121, 5,035,647, 5,052,940, 5,074,803, 5,088,934, 5,104,337, 5,112,243, 5,122,076 and 5,169,346.

While the connectors shown in the above-identified patents provide adequately for the connection of components in a data system, the increasing use of smaller components in such systems requires the use of smaller connectors. However, despite the reduction in size, these connectors still must provide closed loop connections.

It is, therefore, desirable to provide a data connector of reduced size, which provides adequate shunting to maintain closed-loop connections.

SUMMARY OF THE INVENTION

It is an object of the present invention to provide an improved electrical data connector.

It is a further object of the present invention to provide data connector components of reduced size which provide for adequate shunting.

It is a still further object of the present invention to provide a data connector having vertically aligned components.

In the efficient attainment of these and other objects, the present invention provides an electrical connector component assembly for terminating discrete conductors of a multiconductor cable. The component assembly includes an insulative component housing having a mating end for engagement with a mating electrical connection device and an opposed cable receiving end. A plurality of electrical contacts are supported by the component housing. Each of the contacts includes a conductor terminating end and a mating connection end. The contacts are supported within the component housing such that they are aligned in a pair of horizontally extending vertically spaced rows. Each contact of one row is disposed vertically above the contacts of the other row. Shunting means is provided for operatively electrically shunting the contacts of one row to the aligned contacts of the other row.

As more particularly described by way of the preferred embodiment herein, the component assembly of the present invention includes first and second insulative component housings respectively supporting first and second plural electrical contacts. The first insulative housing is supported above the second insulative housing so that the first and second contacts are vertically aligned. Each of the first and second contacts includes a conductor connecting portion at one end and a mating connection portion at the other end. Each mating connection portion includes an elongate contact base portion and a reversely bent cantilevered spring portion extending over the contact base portion. The cantilevered spring portion is deflectable from a first position spaced from the contact base portion to a second position adjacent the contact base portion upon electrical engagement of a mating connecting device. The first contacts further include depending shunt portions extending from the contact base portions for electrical engagement with the cantilevered spring portions of the second contacts when the cantilevered spring portions are in the first position.

DETAILED DESCRIPTION OF THE PREFERRED EMBODIMENT

Figure 1:
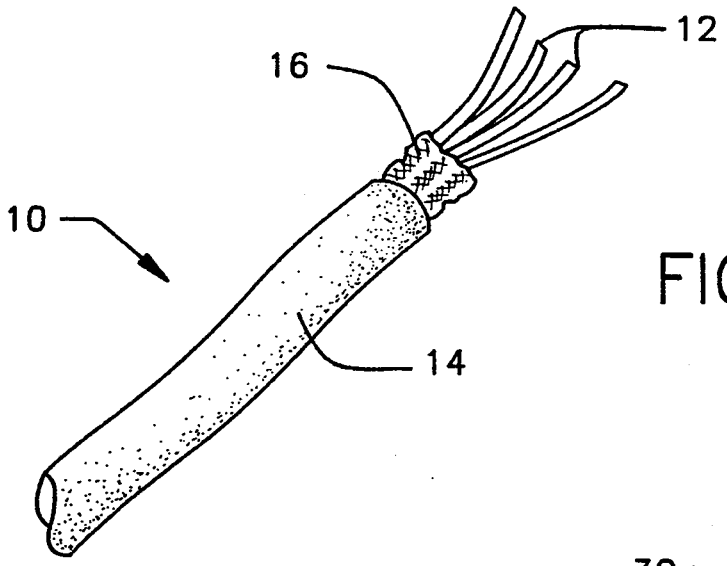
FIG. 1 shows a shielded multiconductor electrical cable used in combination with the present invention.

Referring to FIG. 1, an electrical cable 10 of the type used in accordance with the present invention is shown. Electrical cable 10 is a multiconductor data transmission cable including a plurality of insulated conductors 12 enclosed in an outer insulative jacket 14. A metallic shield 16 is interposed between the conductors 12 and the jacket 14. Shield 16, as is well-known in the art, is used to provide electrical shielding for cable 10. In the present illustrative embodiment, a braided shield 16 is shown. However, shields of other construction, such as metallic foil, may also be employed. Cable 10 is shown prepared for termination with end portions of conductors 12 extending outwardly of jacket 14. A portion of shield 16 is also shown extending from jacket 14.

Figure 2:
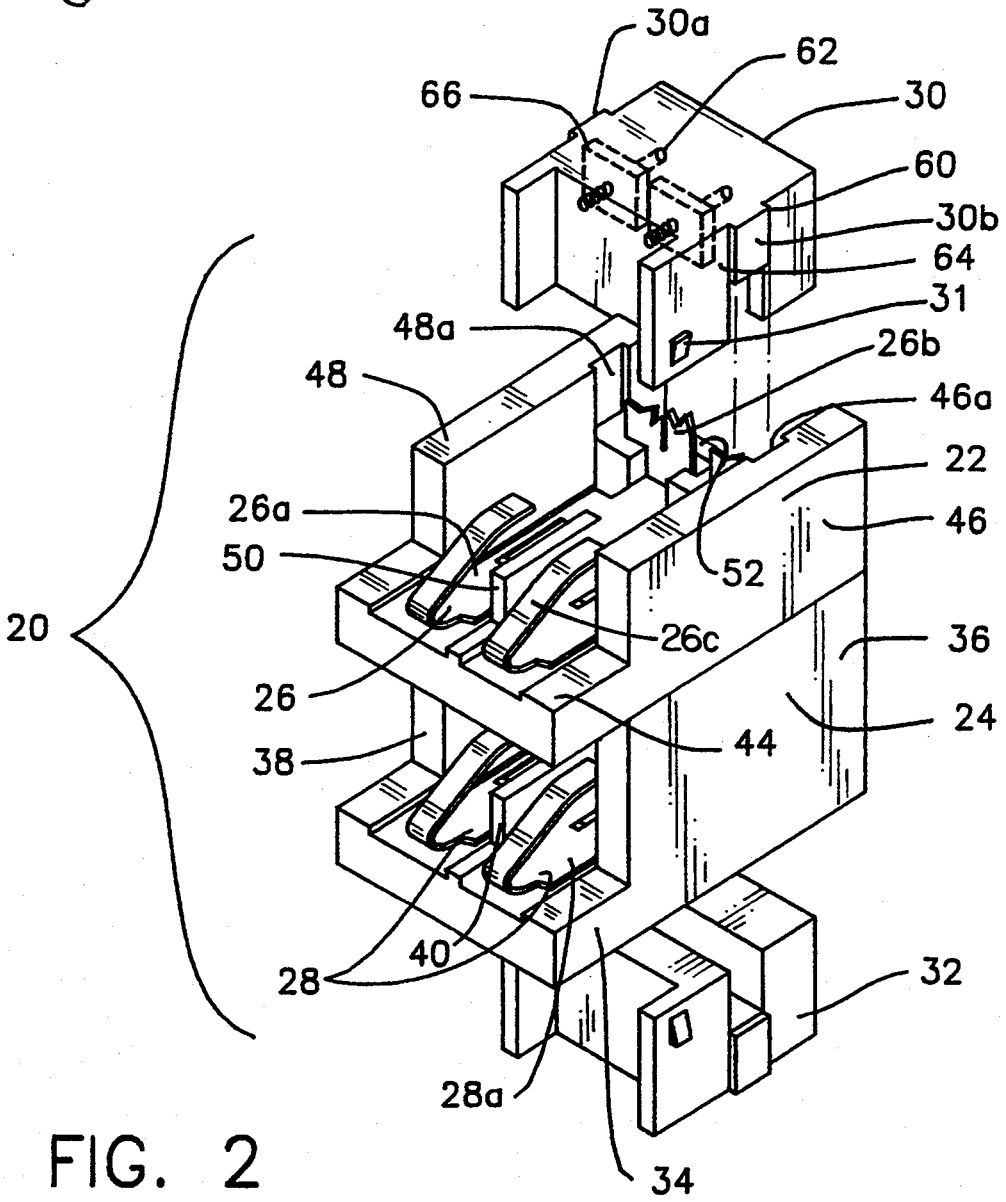
FIG. 2 is a perspective showing of the electrical connector component assembly of the present invention.
Figure 3:
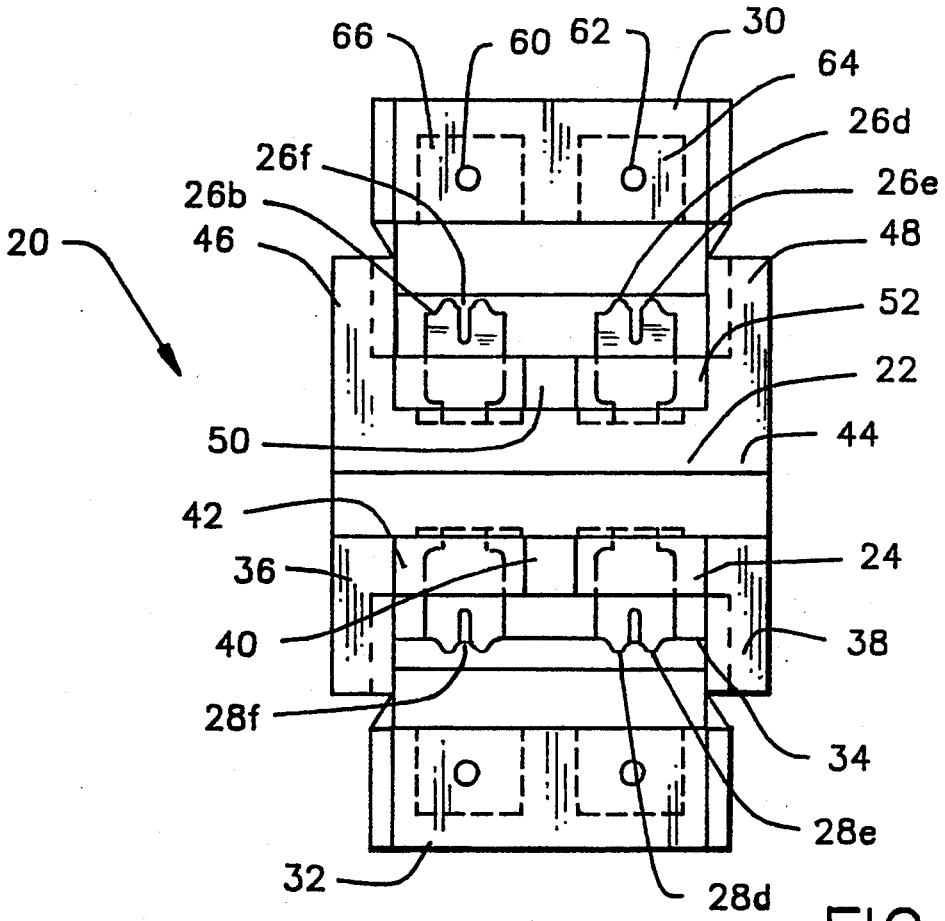
FIGS. 3 and 4 are rear-plan and side-elevational showings, respectively, of the electrical connector component assembly of FIG. 2.
Figure 4:
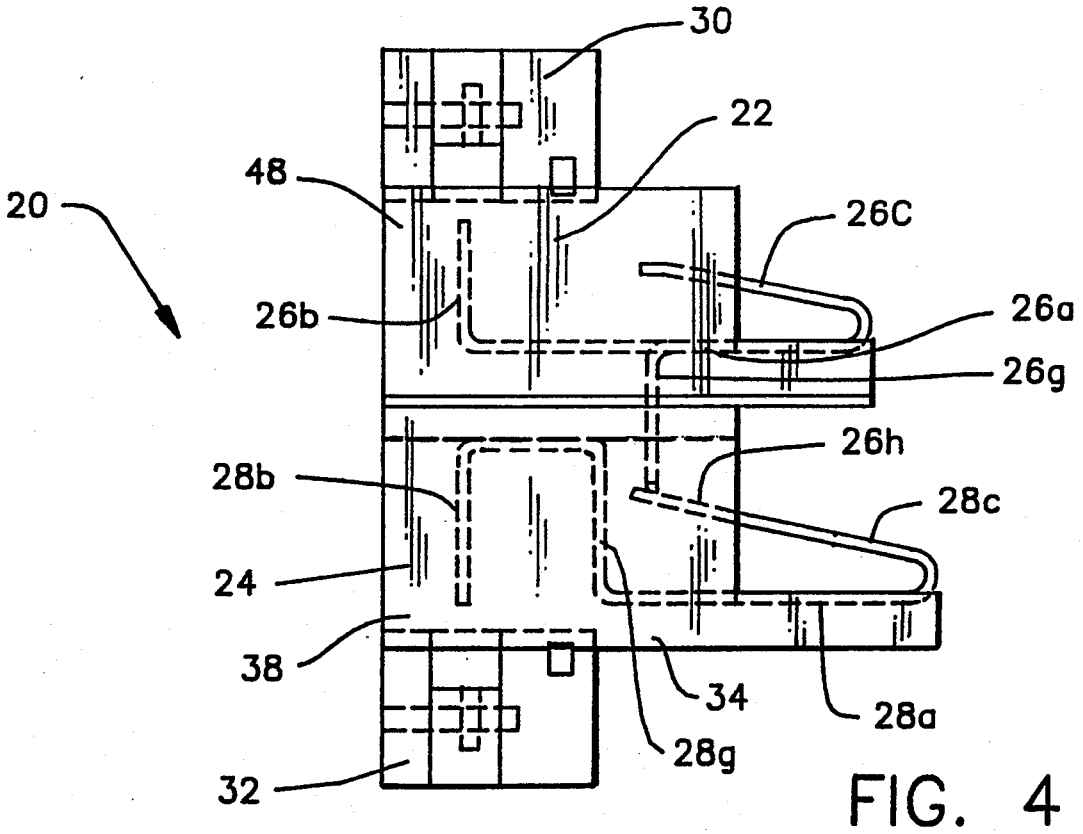

Referring to FIGS. 2–4, the electrical connector component assembly 20 of the present invention may be described. Assembly 20 includes first and second electrically insulative housings 22 and 24 arranged in a vertically stacked relationship. Each housing 22 and 24 supports a pair of electrical contacts 26 and 28 respectively. Assembly 20 further includes a pair of conductor support blocks 30 and 32 which are engageable with housings 22 and 24, respectively, to support conductors 12 of electrical cable 10 in electrical engagement with contacts 26 and 28, as will be further described hereinbelow.

Electrical connector component assembly 20 may be housed within an electrically shielded housing (not shown) to permit electrical interconnection with a further connection device. Connector component assembly 20 and its associated shielded housing may be constructed to be of the hermaphroditic variety so that it will permit interconnection to an identically formed member. Connectors of such construction are shown in several of the above-identified U.S. patents, most notably, U.S. Pat. No. 4,682,836.

Housing 24, which is the lower of the two housings shown in the drawings, includes a bottom wall 34 and two transversely spaced upstanding sidewalls 36 and 38. An upstanding dividing wall 40 suitably electrically isolates contacts 28. As shown in FIG. 3, a transverse wall 42 of height less than the sidewalls extends across a rear portion of bottom wall 34.

Electrical contacts 28 are supported by housing 24. Contacts 28 are formed of a suitably conductive stamped and formed metallic material such as beryllium copper. Contacts 28 include a generally elongate base portion 28*a*, an insulation displacement contact (IDC) portion 28*b* and a reversely bent cantilevered spring portion 28*c*, which extends back over base portion 28*a*. IDC portion 28*b* is of conventional flat-blade configuration, having two spaced relatively sharp tines 28*d* and 28*e*, defining therebetween a conductor receiving slot 28*f*. IDC portion 28*b* is shown extending in a direction opposite that of reversely bent cantilevered spring portion 28*c* so that it may be accessible adjacent bottom wall 34. A contact transition portion 28*g* provides for the inversion of IDC portion 28*b*. Contacts 28 are fixedly secured in housing 24 with contact base portion 28*a* positioned along bottom wall 34. Appropriate housing structure (not shown) inclusive of transverse wall 42 may be employed to support IDC portion 28*b* in housing 24.

Cantilevered spring portion 28*c* is deflectable to move toward and away from base portion 28*a* upon interconnection of a further connecting device in a manner well-known in the art. Upon interconnection, cantilevered spring portion 28*c* will deflect downwardly toward base portion 28*a*, returning to its original position shown in FIG. 4 upon disconnection.

Housing 22, shown as the upper housing in the drawings, is of substantially similar construction to that of housing 24. Housing 22 includes a bottom wall 44 and two transversely spaced upstanding sidewalls 46 and 48. An upstanding dividing wall 50 electrically isolates contacts 26. A transverse wall 52 of height less than the sidewalls extends upwardly from a rear portion of bottom wall 44.

Contacts 26 are of construction similar to that of contacts 28 described above. Contacts 26 include an elongate base portion 26*a*, an insulation displacing contact (IDC) portion 26*b* and a reversely bent cantilevered spring portion 26*c*. IDC portion 26*b* is also of generally flat blade configuration, having sharp tines 26*d* and 26*e* defining therebetween a conductor receiving slot 26*f*. IDC portion 26*b* extends upwardly from base 26*a* in the direction of cantilevered spring portion 26*c*, which is of opposite construction to that of contact 28. Thus, the IDC portions 26*b*, 28*b* of contacts 26 and 28 are accessible from opposite directions.

Figure 5:
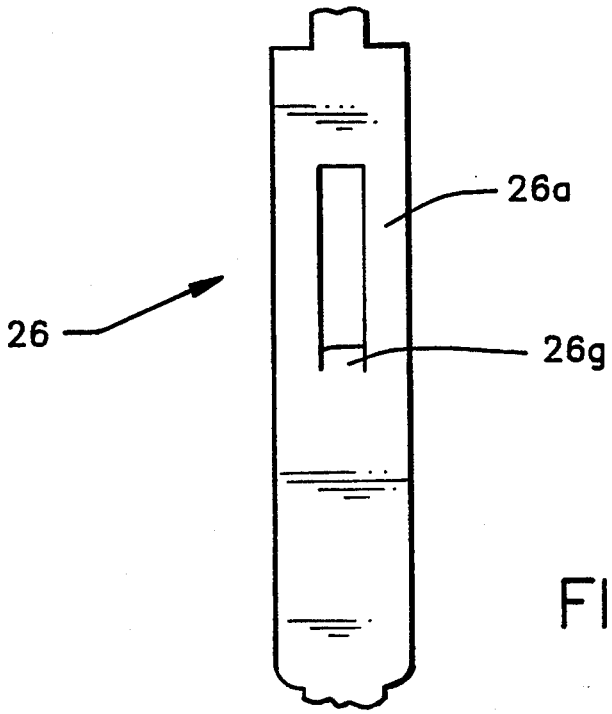
FIGS. 5 and 6 are top and side fragmented showings, respectively, of an electrical contact used in the electrical connector component assembly shown in FIG. 2.
Figure 6:
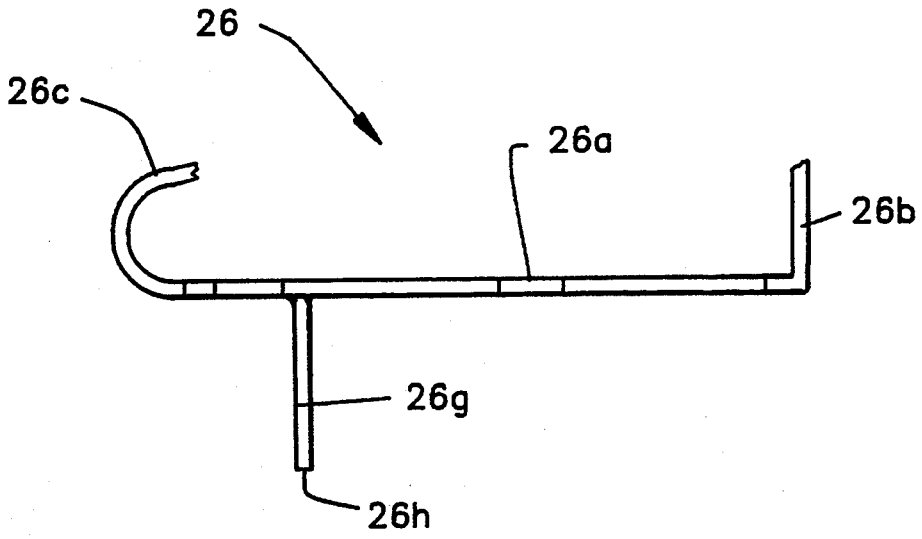

As shown in FIGS. 5 and 6, each contact 26 further includes a depending shunt portion 26*g*. Shunt portion 26*g* is struck from a central extent of the planar base portion 26*a* and is bent downwardly out of the plane of base portion 26*a* to extend at an angle of approximately 90° with respect thereto.

Referring again to FIGS. 2–4, contacts 26 are fixedly secured in housing 22 with each contact 26 being supported on bottom wall 44. Transverse wall 52 is appropriately constructed to support IDC portions 26*b* of contacts 26. Further, bottom wall 44 includes a pair of openings (not shown) which permit shunt portions 26*g* of contacts 26 to extend therethrough.

As shown particularly in FIG. 4, shunt portion 26*g* of each contact 26 extends downwardly toward contact 28, which is vertically aligned therewith, such that a distal extent 26*h* electrically engages cantilevered spring portion 28*c*. In this condition, contact 26 is electrically shunted to contact 28.

As above described, cantilevered spring portion 28*c* of contact 28 is deflectable toward and away from base portion 28*a*. Upon interconnection of another connecting device, cantilevered spring portion 28*c* of contact 28 will deflect downwardly from the position shown in FIG. 4 so that cantilevered spring portion 28*c* is out of engagement with depending shunt portion 26*g* of contact 26. Upon disconnection, cantilevered spring portion 28*c* will return to its original position, as shown in FIG. 4, reconnecting with depending shunt portion 26*g* of contact 26.

To facilitate the termination of cable 10 to connector component assembly 20, conductor support blocks 30 and 32 are employed. Support blocks 30 and 32 are of substantially similar construction. Referring to support block 30 as an example, block 30 is formed of suitably insulative molded plastic and includes a pair of spaced conductor receiving bores 60 and 62, which accommodate two conductors 12 of cable 10. A pair of IDC receiving slots 64 and 66 are positioned adjacent conductor receiving bores 60 and 62 and are in communication therewith. In order to terminate cable 10, two of the conductors 12 are inserted into bores 60 and 62 of block 30. The block 30 is then inserted into housing 22 such that IDC portions 26*b* are accommodated in IDC receiving slots 64 and 66. Appropriate mating structure on sidewalls 46 and 48 and on conductor support block 30 facilitates insertion of support block 30 into housing 22. As shown in FIG. 2, sidewalls 46 and 48 include vertical slots 46*a* and 48*a* which accommodate extending tongues 30*a* and 30*b* of block 30. However, other mating structure may also be employed. Also, a latch or detent such as shown as 31 on block 30 may be employed to provide for a snap fit of block 30 in housing 22. Support block 30, including conductors 12 supported therein, may be manually inserted or inserted under application of an appropriate tool such that conductors 12 are electrically terminated with IDC portions 26*b* in a manner well-known in the connector art. Conductor support block 30 may be formed of a clear molded plastic so that the proper termination of conductors 12 to IDC portions 26*b* may be observed.

Conductor support block 32, being substantially similar to that of conductor support block 30, operates in the same manner to terminate the other two conductors 12 of cable 10 to contacts 28 supported in housing 24. In fact, it is contemplated that conductor support block 32 may be identical to conductor support block 30 so that a single construction may be used in both instances.

As above-mentioned, connector component assembly 20 is supported within a shielded housing for interconnection purposes. The shield of that housing would be appropriately electrically connected to shield 16 of cable 10 which extends from jacket 14. Therefore, in order to maintain shielded isolation as between contacts 26 and 28, the present invention contemplates interposing a metallic shield between housing 22 and housing 24. This metallic shield would be electrically continuous with the shield of the outer housing, which is in turn connected to the shield 16 of cable 10.

Various changes to the foregoing described and shown structures would now be evident to those skilled in the art. Accordingly, the particularly disclosed scope of the invention is set forth in the following claims.

We claim:

1. An electrical connector component assembly for terminating discrete conductors of a multiconductor cable comprising:

an insulative component housing having a mating end for engagement with a mating electrical connection device and a cable receiving end;

a plurality of electrical contacts supported by said component housing, said contacts having conductor terminating ends and mating connection ends;

said contacts being supported in said component housing in a pair of horizontally extending, vertically spaced rows with each contact of one row being aligned with a respective contact of the other row; and, a shunt element extending from each contact of said one row for electrical engagement with an aligned contact of said other row for operatively electrically shunting said contacts of said one row to said aligned contacts of said other row, said mating connection end of each contact including a deflectable portion, said deflectable portions of contacts in one row being deflectable in the same direction as the deflectable portions of contacts in the other row upon connection with said mating electrical connection device.

2. An electrical connector component assembly of claim 1, wherein each contact of said one row includes a respective shunt element integrally formed therewith.

3. An electrical connector component assembly of claim 2, wherein said shunt element of each of said contacts of said first row is engageable with a respective deflectable portion of said contacts of said second row.

4. An electrical connector component assembly of claim 2 wherein said conductor terminating ends of said contacts include insulation displacing contact portions for insulation displacing connection with said conductors of said cable.

5. An electrical connector component assembly of claim 4 wherein each said contact includes a contact base portion extending between said deflectable portion and said insulation displacing contact portion, said shunt elements of said contacts of said one row extending from said contact base portions.

6. An electrical connector component assembly for terminating conductors of a multiconductor cable comprising;

a first insulative component housing including a bottom wall supporting first plural electrical contacts; and a second insulative component housing including a bottom wall supporting second plural electrical contacts;

said first housing being supported above said second housing so that said first and second plural contacts are vertically aligned;

each of said first and second contacts being elongate and including a conductor connection portion at one end thereof and mating connection portion at the other end thereof for electrical engagement with a mating electrical connector, each said mating connection portion including an elongate contact base portion and a cantilevered spring portion extending over said contact base portion, said cantilevered spring portion being deflectable from a first position spaced from said contact base portion to a second position adjacent said contact base portion upon said electrical engagement of said mating electrical connector, said cantilevered spring portion being returnable to said first position upon disengagement of said mating electrical connector;

each said first plural electrical contact including a depending shunt portion extending from said contact base portion through said bottom wall of said first component housing for electrical engagement with said cantilevered spring portion of said second electrical contact positioned therebelow when said cantilevered spring portion is in said first position.

7. An electrical connector component assembly of claim 6 wherein each said contact base includes a flat planar member and wherein said shunt portion of said first contact includes an extent of said planar member bent out of the plane of said planar member in the direction of said second contacts.

8. An electrical connector component assembly of claim 7 wherein said conductor connection portions of said first and second contacts include insulation displacing contact elements for insulation displacing connection with said conductors of said multiconductor cable.

9. An electrical connector component assembly of claim 8 wherein said insulation displacing contact elements of said first contacts and said insulation displacing contact elements of said second contacts extend in opposite directions.

10. An electrical connector component assembly of claim 9 further including first and second conductor holding blocks for supporting of said conductors of said multiconductor cable adjacent said insulation displacing contact elements.

11. An electrical connector component assembly of claim 10 wherein said first and second conductor holding blocks are supported by said first and second component housings respectively.

12. An electrical connector component assembly of claim 1 wherein said one row of contacts is supported above said other row of contacts and wherein said shunt element of each said contacts of said one row includes said shunt portion depending therefrom to operatively electrically engage said contacts of said other row.

13. A compact electrical data connector comprising;

an insulative connector housing interconnectable with a mateable connector housing;

a first set of electrical contacts supported by a first wall of said insulative connector housing and occupying a transverse expanse;

a second set of electrical contacts supported by a second wall of said insulative connector housing, said second set of electrical contacts being spaced from and overlying said first set within said transverse expanse, said second wall being disposed between said first and second sets of electrical contacts;

said first and second sets of contacts being mutually mateable with complementary contacts of said mateable connector housing; and each electrical contact of one of said sets including a shunt member integrally formed therewith and extending through said second wall to directly, separably engage an electrical contact of the other set of contacts in the absence of interconnection with said mateable connector housing.

14. A connector as claimed in claim 13, wherein said first and second sets of contacts include hermaphroditic interengagement portions for electrical connection with said complementary contacts of second mateable connection.

15. A connector as claimed in claim 14, wherein said contacts of said first set are vertically spaced from said contacts of said second set.

16. An electrical connector for mateable interconnection with other electrical apparatus, said connector comprising:

an insulative housing;

a first set of electrical contacts, each having a deflectable mating portion, a terminal portion, and a generally flat connecting portion therebetween, said first set of contacts being supported in side-by-side disposition on said housing with said connecting portions being generally in a first plane;

a second set of electrical contacts, each having a deflectable mating portion, a terminal portion, and a generally flat connecting portion therebetween, said second set of contacts being supported in side-by-side disposition on said housing with said connecting portions being generally in a second plane spaced from said first plane, all said deflectable mating portions of said first and second sets of contacts being deflectable in the same direction upon interconnection with said other apparatus; and at least one shunt member separably shunting at least one contact of said first set to a contact of said second set.

17. An electrical connector according to claim 16, wherein said separably shunted contacts of said first and second sets are aligned in mutual registry.

18. An electrical connector according to claim 17, wherein a shunt member is formed integrally with each of said contacts of one of said first and second sets.

19. An electrical connector according to claim 18, wherein each of said shunt members is separable from a deflectable mating portion of said contacts of the other of said first and second sets.

* * * * *